US010010930B1

(12) United States Patent
Williams et al.

(10) Patent No.: US 10,010,930 B1
(45) Date of Patent: Jul. 3, 2018

(54) WAX MOLD FOR INVESTMENT CASTING AND METHOD OF ASSEMBLING A WAX MOLD

(71) Applicant: Signicast LLC, Hartford, WI (US)

(72) Inventors: Brian Alan Williams, Slinger, WI (US); James Okonek, Hartford, WI (US)

(73) Assignee: Signicast LLC, Hartford, WI (US)

( * ) Notice: Subject to any disclaimer, the term of this patent is extended or adjusted under 35 U.S.C. 154(b) by 12 days.

(21) Appl. No.: 15/379,668

(22) Filed: Dec. 15, 2016

(51) Int. Cl.

| | |
|---|---|
| ***B22C 7/02*** | (2006.01) |
| ***B22C 9/04*** | (2006.01) |
| ***B22C 9/22*** | (2006.01) |
| ***B23K 31/02*** | (2006.01) |

(52) U.S. Cl.
CPC ..... *B22C 7/02* (2013.01); *B22C 9/04* (2013.01); *B22C 9/22* (2013.01); *B23K 31/02* (2013.01)

(58) Field of Classification Search
CPC .. B22C 7/02; B22C 7/026; B22C 9/04; B22C 9/22
USPC ..... 164/23, 516, 34, 35, 45, 235, 236, 244, 164/246, 249
See application file for complete search history.

(56) References Cited

U.S. PATENT DOCUMENTS

| | | | | |
|---|---|---|---|---|
| 2,399,373 | A | 4/1946 | Miller | |
| 3,424,227 | A | 1/1969 | Watts | |
| 3,511,466 | A | 5/1970 | Kaplan | |
| 3,520,349 | A * | 7/1970 | Watts | B22C 7/02 164/244 |
| 4,040,466 | A | 8/1977 | Horton | |
| 4,064,927 | A * | 12/1977 | Ostrowski | B22C 7/02 164/244 |
| 4,081,019 | A | 3/1978 | Kulig | |
| 4,161,208 | A | 7/1979 | Cooper | |
| 6,910,519 | B2 | 6/2005 | Ludwig et al. | |
| 7,270,166 | B2 * | 9/2007 | Jakus et al. | B22C 7/02 164/122.1 |
| 7,942,189 | B1 | 5/2011 | Quraishi et al. | |
| 8,225,841 | B1 | 7/2012 | Davidson | |
| 8,939,192 | B2 | 1/2015 | Solesbee et al. | |
| 2008/0142183 | A1 * | 6/2008 | Marshall et al. | B22C 7/02 164/36 |
| 2012/0168109 | A1 * | 7/2012 | Davidson | B22C 9/04 164/15 |
| 2014/0060115 | A1 | 3/2014 | Saarela et al. | |
| 2014/0190650 | A1 * | 7/2014 | McGuire et al. | B22C 9/04 164/34 |
| 2014/0262107 | A1 * | 9/2014 | Hanrahan et al. | B22C 9/043 164/34 |
| 2014/0262108 | A1 | 9/2014 | Hanrahan et al. | |

FOREIGN PATENT DOCUMENTS

| | | |
|---|---|---|
| DE | 3416134 | 11/1985 |

* cited by examiner

*Primary Examiner* — Kevin P Kerns
(74) *Attorney, Agent, or Firm* — Michael Best & Friedrich LLP

(57) ABSTRACT

A wax mold for investment casting includes a sprue having at least one pattern support. The pattern support includes a plurality of sockets formed therein. The wax mold further includes a plurality of wax patterns. Each wax pattern has a portion received in a respective one of the plurality of sockets to support the wax patterns on the at least one pattern support.

21 Claims, 5 Drawing Sheets

WAX MOLD FOR INVESTMENT CASTING AND METHOD OF ASSEMBLING A WAX MOLD

BACKGROUND

The present invention relates to investment casting, and more specifically to wax molds for investment casting.

The investment casting process (or lost wax process) has been used for thousands of years to create components out of metal. The process starts by creating a pattern out of wax that is a close replica of the final part. The wax pattern gets attached to a sprue to form a mold. The mold gets dipped or "invested" in liquid ceramic and then coated with sand to develop a ceramic shell around the mold. That dipping process can occur multiple times so that a sturdy shell is created around the wax. The wax is then removed (i.e., melted away), the empty mold is heated, and metal is poured into the empty mold. The cast parts are removed from the ceramic shell and finished to final form.

Wax patterns are created with a "gate" attached to them. The gate is the spot where 1) the wax pattern is attached to the sprue to create the mold; 2) the metal flows into the part; and 3) the parts gets separated from the sprue after the part is poured. Assembly of the mold occurs by attaching the wax patterns to the sprue. Attaching the wax patterns to the sprue typically includes the use of a guide that identifies placement of the patterns on the sprue. The guide is placed next to the sprue and the operator marks, typically with a marker, the spot on the sprue where the pattern is to be attached. Operators then heat a flat distal end of the gate and/or flat mating surface of the sprue, orient and place the gate in the previously marked location, and then melt the wax on the gate and sprue to "weld" the gate/pattern to the sprue. A torch is commonly used by the operator to perform this welding. The process is then repeated with each pattern until the mold is completely assembled.

SUMMARY

The present invention provides an improved sprue that facilitates the attachment of the wax patterns for building the wax mold. The wax patterns are also designed to cooperate with the sprue to facilitate either manual or automated assembly of the wax mold.

The invention provides, among other things, a wax mold for investment casting. The wax mold includes a sprue having at least one pattern support. The pattern support includes a plurality of sockets formed therein. The wax mold further includes a plurality of wax patterns. Each wax pattern has a portion received in a respective one of the plurality of sockets to support the wax patterns on the at least one pattern support.

In another aspect, the invention provides a method of assembling a wax mold. The wax mold has at least one pattern support with a plurality of sockets formed therein, and a plurality of wax patterns. The method includes positioning a portion of each of the wax patterns into a corresponding one of the plurality of sockets such that the wax patterns are supported within the sockets. The method further includes heating an interface between each socket and wax pattern to weld the wax patterns into the respective sockets.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
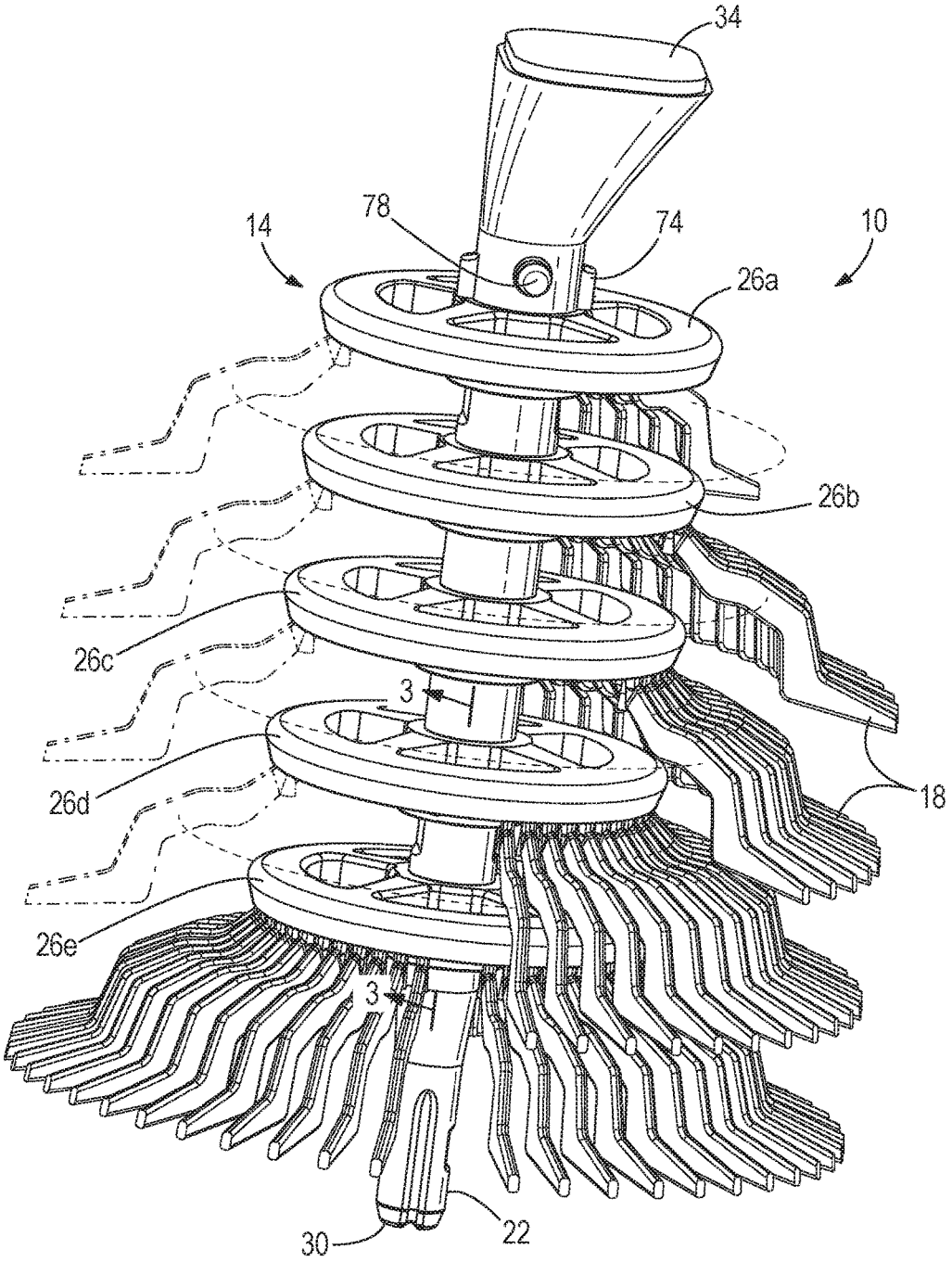
FIG. 1 is perspective view of an assembled wax mold embodying the present invention.
Figure 2:
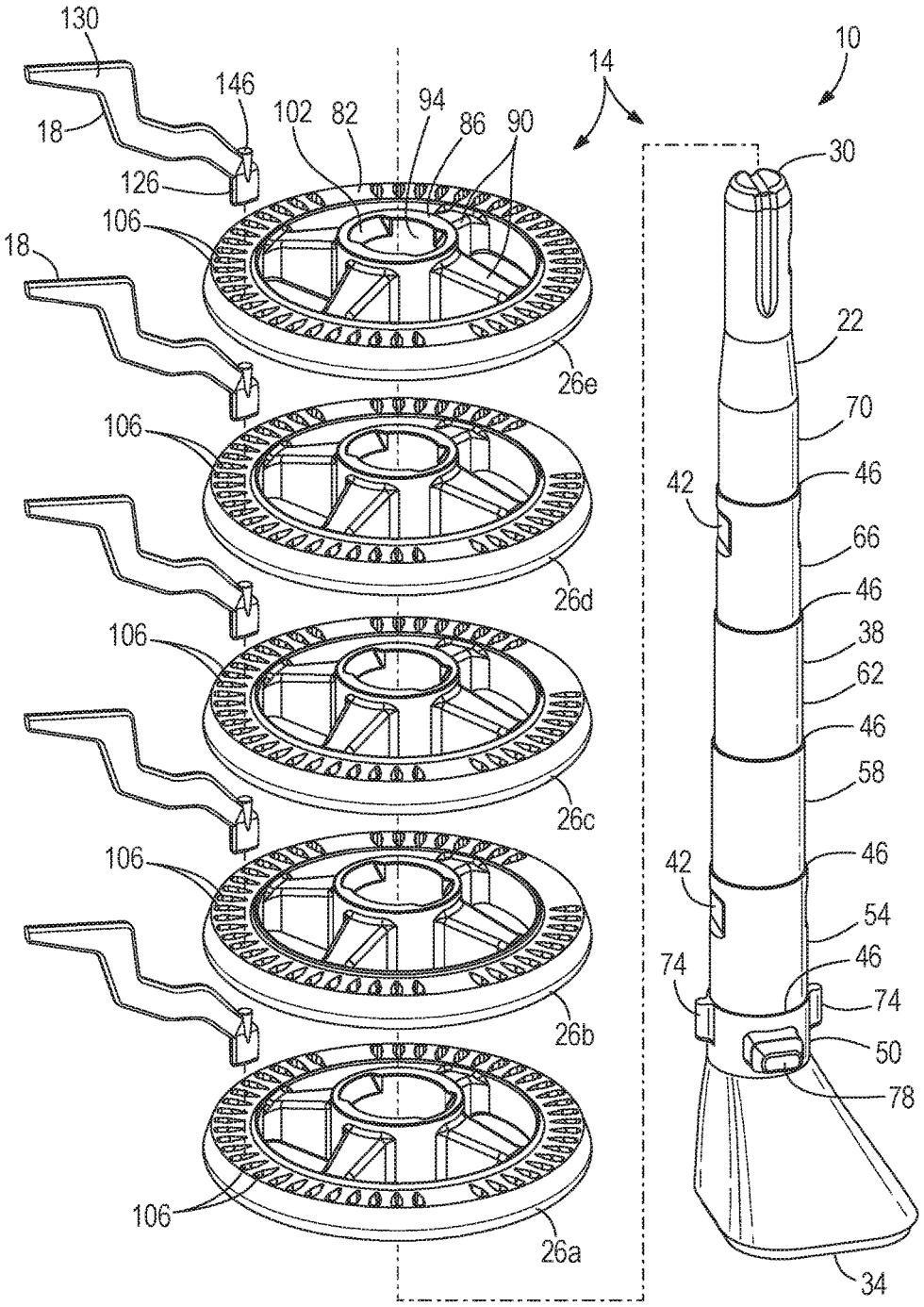
FIG. 2 is an exploded view of the wax mold of FIG. 1, shown in an orientation used for building the wax mold.

FIGS. 1 and 2 illustrate a wax mold 10 according to the present invention. The wax mold 10 includes a sprue 14 and a plurality of wax patterns 18 coupled to the sprue 14. As is understood to those of skill in the investment casting art, the sprue 14 is the support structure of the wax mold 10 that supports the plurality of wax patterns 18. The illustrated sprue 14 is an assembly of multiple parts or portions made of wax, that are ultimately coupled together into an interconnected sprue structure. Specifically, the illustrated sprue 14 includes a post 22 and a one or more pattern supports 26*a*, 26*b*, 26*c*, 26*d*, 26*e* coupled to the post 22.

As best shown in FIG. 2, the post 22 is sized and configured to support the pattern supports 26*a*, 26*b*, 26*c*, 26*d*, 26*e* in spaced-apart relation along the length of the post 22. In the illustrated embodiment, the post 22 is integrally formed (e.g., molded) of wax as one piece. The post 22 has a first end 30, a second end 34, and a body portion 38 extending between the ends 30, 34. The first end 30 is configured as desired for handling and manipulation of the wax mold 10 during the assembly and dipping processes. The second end 34 is configured in the shape of a funnel or spout, as is understood in the art, to provide the inlet shape to the ceramic shell for receiving the molten metal. The body portion 38 is illustrated as tapering in size as it extends from the second end 34 toward the first end 30. The body portion 38 can also include recesses or notches 42 at various locations along the axial length for recessing injection runner points to make clearance for the sprue 14.

The body portion 38 of the post 22 also includes a plurality of steps 46 formed thereon at axially spaced-apart intervals. As will be discussed further below, the steps 46 operate to create the desired axial spacing of the pattern supports 26*a*, 26*b*, 26*c*, 26*d*, 26*e* along the post 22. The illustrated steps 46 are formed by virtue of the body portion 38 including a plurality of cylindrical segments 50, 54, 58, 62, 66, and 70 that have different outer diameters. As shown in FIG. 2, the cylindrical segment 50 adjacent the second end 34 has the largest outer diameter, while the cylindrical segment 70 closest to the first end 30 has the smallest outer diameter. The intervening cylindrical segments 54, 58, 62, and 66 are sequentially reduced in outer diameter. This contributes to the overall tapered form of the body portion 38. The steps 46 are formed at the interfaces between adjacent cylindrical segments 50, 54, 58, 62, 66, and 70. The cylindrical segment 50 is also shown to include projections 74 that cooperate with the associated step 46 to help support one of the pattern supports 26*a*. Additional projections 78 on the cylindrical segment 50 can be provided as desired for handling and manipulation of the mold after the casting process.

While the illustrated post 22 includes six cylindrical segments 50, 54, 58, 62, 66, 70 to form five steps 46 (corresponding with the illustrated five pattern supports 26*a*, 26*b*, 26*c*, 26*d*, 26*e*), it is to be understood that other embodiments may include fewer or more segments 50, 54, 58, 62, 66, 70 and steps 46 depending upon the particular casting application. Furthermore, while the illustrated segments 50, 54, 58, 62, 66, 70 are shown as being cylindrical in shape, other embodiments could include different geometries, such as segments having rectangular, square, or other polygonal cross-sections.

Figure 3:
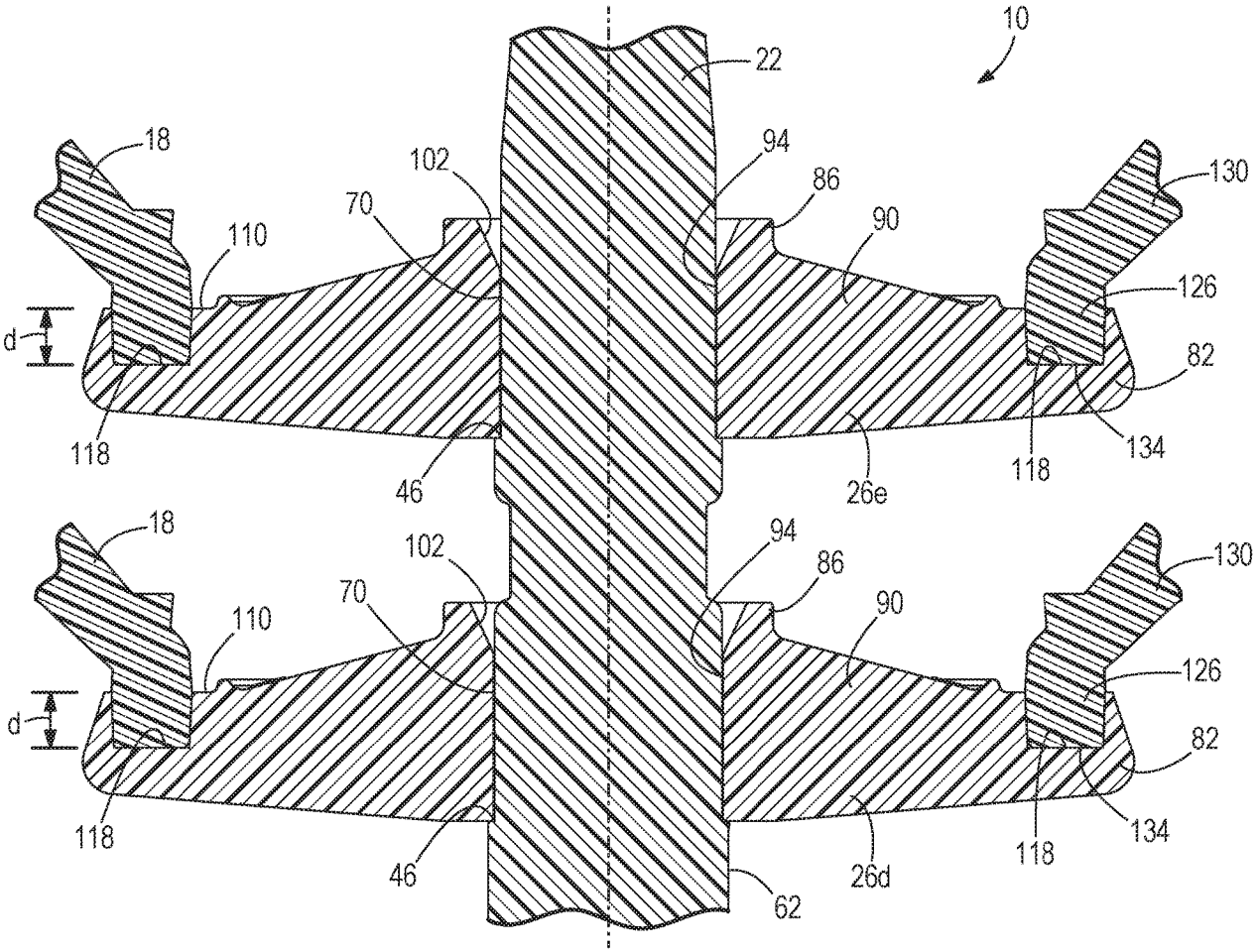
FIG. 3 is a partial section view taken through line 3-3 of FIG. 1.

The illustrated pattern supports 26*a*, 26*b*, 26*c*, 26*d*, 26*e* are initially molded individually from wax, and are then assembled onto the post 22. Each pattern support 26*a*, 26*b*, 26*c*, 26*d*, 26*e* includes a body portion 82, which in the illustrated embodiment is annular in shape to encircle the post 22 when the pattern support is installed onto the post 22. A hub 86 is provided to interconnect each pattern support to the post 22, and a plurality of spokes 90 interconnect and space each hub 86 relative to the body portion 82. In the illustrated embodiment, the hub 86 of each pattern support 26*a*, 26*b*, 26*c*, 26*d*, 26*e* is sized and configured with a bore 94 of a different inner diameter to substantially corresponds to a respective outer diameter of one of the cylindrical segments 50, 54, 58, 62, 66, 70. With reference to FIGS. 2 and 3, assembly of the sprue 14 occurs by first placing the pattern support 26*a* onto the post 22 by passing the first end 30 through the bore 94 of the hub 86 and moving it along the body portion 38 (downwardly in FIGS. 2 and 3) until the hub 86 is positioned over the cylindrical segment 54. The inner diameter of the bore 94 is similar in size to the outer diameter of the segment 54 to provide an interference fit. Further axial movement of the pattern support 26*a* toward the second end 34 is limited by abutment of the hub 86 with the step 46 formed between the segments 50 and 54, and the projections 74.

Figure 4:
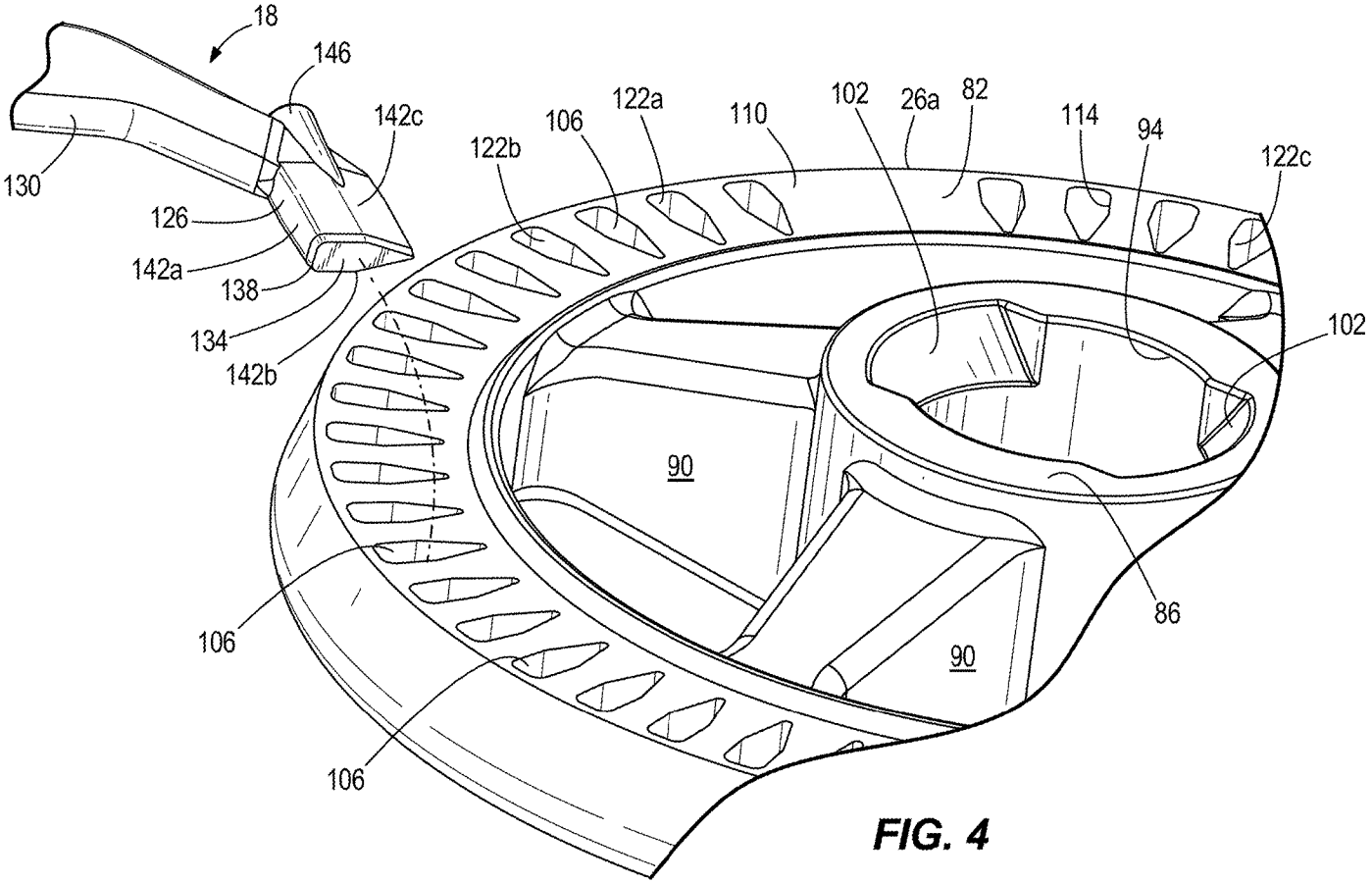
FIG. 4 is an enlarged, partial exploded view illustrating the wax pattern and a socket in the sprue for receiving the wax pattern.

The remainder of the pattern supports 26*b*, 26*c*, 26*d*, and 26*e* can be sequentially assembled onto the post 22 in the same manner, such that the support 26*b* abuts a step 46 and comes to rest along segment 58, the support 26*c* abuts a step 46 and comes to rest along segment 62, the support 26*d* abuts a step 46 and comes to rest along segment 66, and the support 26*e* abuts a step 46 and comes to rest along segment 70. In this manner, the pattern supports 26*a-e* are easily installed onto the post 22 in the correct sequence to achieve the correct spacing between the individual pattern supports 26*a-e*, thereby ensuring the proper build of the wax mold 10. The individual pattern supports 26*a-e* can be secured in place along the post 22 by welding using a torch 98 (see FIG. 5) or another appropriate heat-generating device to melt the wax of the hub 86 and/or the post 22 at the respective interfaces. As best shown in FIGS. 3 and 4, each hub 86 can include one or more chamfers 102 at one axial end that defines a lead-in to the bore 94. The heating can occur around the bore 94 and in the vicinity of the chamfers 102 such that melted wax will flow into the chamfers 102 and into the bore 94 to weld the hub 86 to the post 22. This welding can be performed manually or using an automated machine. Alternatively, pins could be used to secure the pattern supports 26*a-e* to the post 22.

Just as different geometries of the post segments 50, 54, 58, 62, 66, and 70 are contemplated above, the geometry of the pattern supports 26*a-e* can also vary in conjunction with changes to the post 22. For example, if the segments 50, 54, 58, 62, 66, and 70 were formed with a square cross-sectional shape, the bore 94 of each hub 86 could likewise have a corresponding square shape. Furthermore, while the body portions 82 are illustrated as being generally ring-shaped, other embodiments could include body portions 82 having square, rectangular, or other polygonal shapes depending upon the particular application.

Once the sprue 14 has been assembled in the manner described above, the wax patterns 18 can be installed onto the pattern supports 26*a-e*. To greatly facilitate the connection of the wax patterns 18 with the pattern supports 26*a-e*, each pattern support 26*a-e* includes one or more sockets 106 formed therein. The sockets 106 are formed into a first surface 110 (see FIGS. 4 and 5) of the body portion 82 of the pattern supports 26*a-e*. That first surface 110 is a surface that faces upwardly while the wax mold 10 is being built (see the orientation shown in FIGS. 2-4) to provide both easy access to the sockets 106 by a human or machine operator, and to enable the wax patterns 18 to be retained in place prior to welding. Each socket 106 defines a hollow or recess into which a portion of a corresponding wax pattern 18 can be inserted. Each socket 106 includes an opening 114 formed in the first surface 110, and the socket 106 extends into the body portion 82 a depth d (see FIG. 3), before terminating at a bottom wall 118 that is spaced from the first surface 110. In the illustrated embodiment, the depth d of the socket 106 is about one half a thickness of the body portion 82 of the pattern support 26*a-e* at the location of the socket 106. However, in other embodiments, the depth d can be varied as desired depending upon the specific wax patterns 18 being used.

A plurality of side walls 122*a*, 122*b*, and 122*c* further define the socket 106 and extend between the opening 114 and the bottom wall 118. With reference to FIG. 4, the illustrated side walls 122*a*, 122*b*, and 122*c* include a radially outer-most wall 122*a* and two opposing radially-extending walls 122*b*, 122*c*, which each begin at the wall 122*a* and extend radially inwardly toward the hub 86. The walls 122*b* and 122*c* initially run parallel to one another but then converge toward one another to eventually intersect at a point that is the radially inner-most point of the socket 106. In this regard, it can be said that the walls 122*b* and 122*c* are at least partially oblique to each other and to the wall 122*a*. By virtue of these walls 122*a*, 122*b*, and 122*c*, it can also be seen how the openings 114 formed in the pattern supports 26*a-e* taper toward one end, namely the radially inner-most end, to form a generally triangular or arrowhead shape. As will be described further below, this tapered configuration of the openings 114 facilitates the retention of the wax patterns 18 in the sockets 106 and also facilitates the welding of the wax patterns 18 into the sockets 106.

The wax patterns 18 each include a gate portion 126 and a part portion 130. The part portion 130 will vary depending upon the shape and size of the part to be formed. The gate portion 126 is sized and configured to correspond at least in part to the shape of the socket 106 for insertion and retention therein. As best seen in FIG. 4, the gate portion includes a bottom surface 134 having a perimeter that corresponds in size and shape to the opening 114. A chamfer 138 can be formed on the bottom surface 134 to facilitate insertion of the gate portion 126 into the opening 114, either manually or via an automated machine. Side surfaces 142*a-c* correspond to respective side walls 122*a-c* of the socket 106 such that a snug interference fit is achieved upon insertion of the gate portion 126 into the socket 106. The bottom surface 134 can abut the bottom wall 118, as shown in FIG. 3, when the gate portion 126 is fully inserted into the socket 106. By virtue of the snug fit between the gate portion and the socket 106, and by virtue of the tapered shape of both the socket 106 and the gate portion 126, the wax patterns 18 are securely retained within the sockets 106 before they are welded in place. This is true even for wax patterns 18 that extend from and have a significant amount of mass spaced a large distance radially outwardly from the pattern supports 26*a-e*. The snug fit, the predetermined depth d, and the tapered shapes of the sockets 106 and gate portions 126 counteract the bending moment that would otherwise cause the wax patterns 18 to fall off of the pattern supports 26*a-e* were the connections attempted using the prior art method of merely welding a flat distal end of the wax pattern to a planar surface of the pattern support.

The use of the sockets 106 enables all of the wax patterns 18 to be installed onto the pattern supports 26*a-e* before any welding is needed to secure them in place. This is in contrast to prior art methods in which each wax pattern had to be both located and welded one-at-a-time. Furthermore, because the sockets 106 are accurately positioned during the molding of the pattern supports 26*a-e*, there is no need for any guide, template, or measuring to locate the wax patterns 18 on the pattern supports 26*a-e*. Instead, the location and spacing of the wax patterns 18 is predetermined and maximized by the location of the sockets 106, which are formed automatically when molding the pattern supports 26*a-e*. A human operator can quickly and easily install all of the wax patterns 18 into the respective sockets 106 without concern for accurate placement. Alternatively, an automated machine can also be used to install the wax patterns 18 into the sockets 106, with the machine's controller being programmed with the incremental spacing parameters required to locate the sockets 106. In the illustrated embodiment, the wax patterns 18 each include a cylindrical boss 146, which can be used to facilitate handling and placement of the wax patterns 18 by an automated machine. Of course, the specific size, configuration, and location of the boss 146 can vary depending upon the machine being used.

Figure 5:
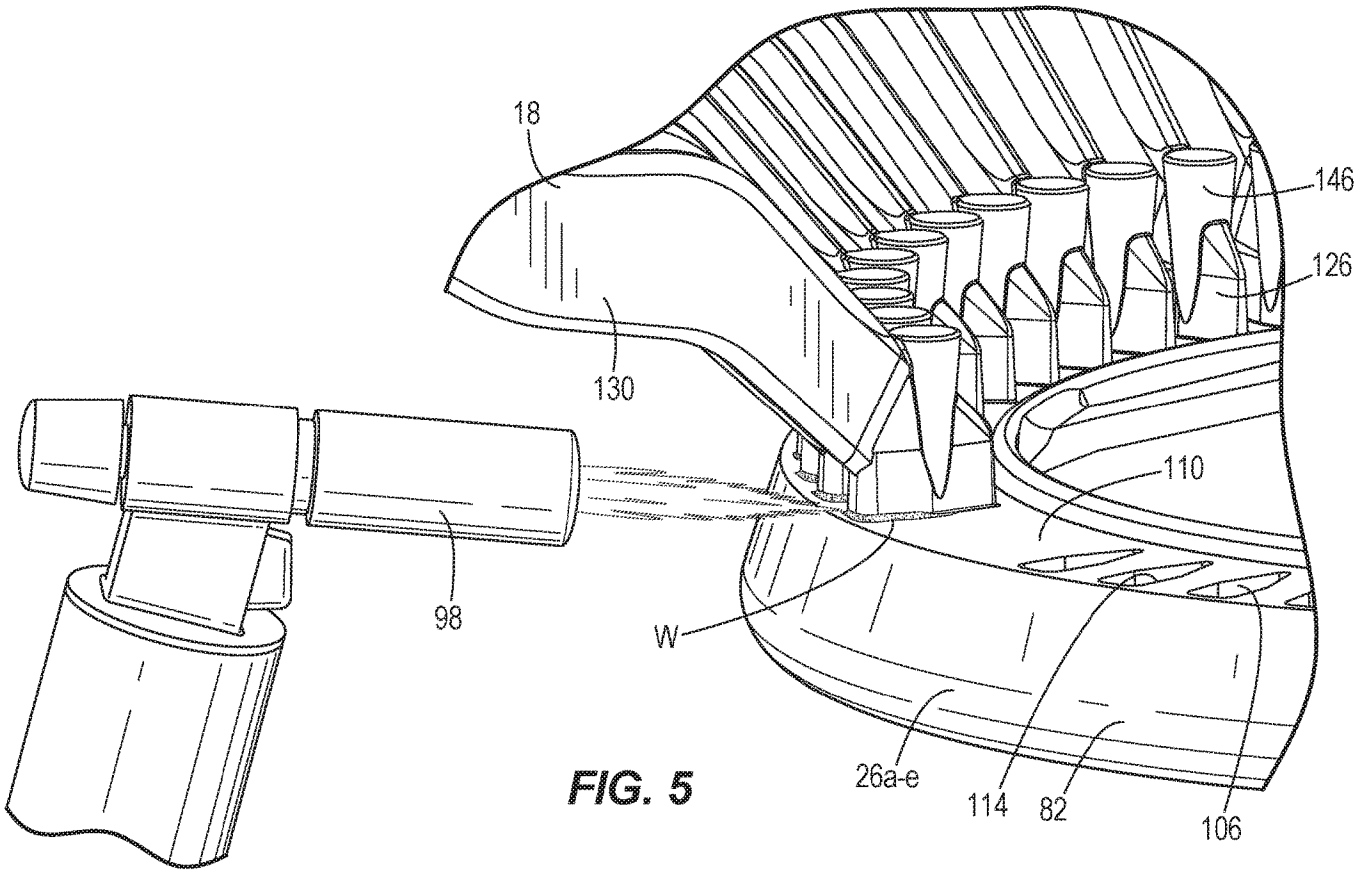
FIG. 5 is an enlarged partial view illustrating wax patterns positioned in respective sockets of a sprue and the application of heat for welding the wax patterns into the sockets.

After all of the wax patterns 18 have been installed into the sockets 106, the wax patterns 18 can be welded to the pattern supports 26*a-e* to secure them in place. As best shown in FIG. 5, a torch 98 can be used to heat the interface between each socket 106 and gate portion 126. Based on the configuration of the sockets 106 and the corresponding geometry of the gate portions 126, and more specifically due to the narrowing configuration in which the sockets 106 and gate portions 126 taper from wider to narrower in the radially inward direction, it is possible to weld the gate portions 126 into the sockets 106 with the heat from the torch 98 applied solely from one end (i.e., the radially outermost, wider end) of the socket 106. As shown in FIG. 5, when the heat from the torch 98 is provided from the radially outer-most and wider end of the socket 106, the melting wax W flows via capillary action in the radially inward direction and is assisted by the tapering of the socket 106 so as to seal and weld around the entire perimeter of the opening 114. The heat need not be moved or applied to multiple locations around the perimeter of the opening 114, but instead can be applied from the single wider end of the opening 114 and still achieve sealing/welding all the way to the narrow end of the opening 114. A human operator or an automated machine can perform this heating with the torch 98 by spinning or rotating the sprue 14 relative to the torch 98, thereby effectively moving the torch around the outer perimeter of each pattern support 26*a-e*. This simplified welding process greatly reduces the time and effort required to weld the wax patterns 18 to the pattern supports 26*a-e*.

It is to be understood that the use of the sockets 106 for supporting the wax patterns 18 need not be used only with the illustrated sprue 14, and its particular form for assembly with the post 22 and the pattern supports 26*a-e*. Instead, various different conventional sprues could be modified to include the inventive arrangement of the sockets 106 and mating gate portions 126. This would include arrangements in which the pattern supports are pinned or otherwise secured to the post (i.e., without the steps 46 or cylindrical segments 50, 54, 58, 62, 66, and 70), or in which pattern supports of varying geometries do not get mounted onto posts at all. The use of the sockets 106 and the mating gate portions 126 greatly facilitates the positioning and securing of the wax patterns 18 to any suitable pattern support portion of a sprue, both in a manual or a machine-automated process.

Various features and advantages of the invention are set forth in the following claims.

What is claimed is:

1. A wax mold for investment casting, the wax mold comprising:

a sprue having at least one pattern support, the pattern support including a plurality of sockets formed therein; and a plurality of wax patterns, each wax pattern having a part portion conforming in shape to a part to be made by investment casting, and an integrally-formed gate portion, each gate portion received in a respective one of the plurality of sockets such that the wax patterns are mechanically retained in place on the at least one pattern support before any welding of the wax patterns to the at least one pattern support.

2. The wax mold of claim 1, wherein the sprue further comprises a post supporting the at least one pattern support.

3. The wax mold of claim 2, wherein the pattern support includes a body portion encircling the post, and wherein the plurality of sockets are arranged in the body portion to encircle the post.

4. The wax mold of claim 3, wherein the pattern support further includes a hub coupled to the post and a plurality of spokes extending between the hub and the body portion.

5. The wax mold of claim 4, wherein the hub includes a chamfer at an axial end, the chamfer facilitating securing of the hub to the post.

6. The wax mold of claim 2, wherein the at least one pattern support includes a plurality of pattern supports, each of the plurality of pattern supports including a plurality of sockets formed therein, the plurality of pattern supports being secured to the post at axially spaced-apart intervals.

7. The wax mold of claim 6, wherein the post includes a plurality of steps formed thereon at axially spaced-apart intervals, each step abutting one of the plurality of pattern supports to locate the pattern supports at the axially spaced-apart intervals.

8. The wax mold of claim 7, wherein the post includes a plurality of cylindrical segments having different outer diameters, the steps being formed at the interfaces of the plurality of cylindrical segments, and wherein the pattern supports each include a body portion, a hub, and a plurality of spokes extending between the hub and the body portion, and wherein the hub of each pattern support has a different inner diameter substantially corresponding to an outer diameter of one of the plurality of cylindrical segments.

9. The wax mold of claim 1, wherein each of the plurality of sockets defines an opening in the pattern support that tapers at one end.

10. The wax mold of claim 1, wherein each of the plurality of sockets includes a bottom wall and a plurality of side walls extending from the bottom wall to an opening in the pattern support.

11. The wax mold of claim 10, wherein one side wall is oblique to another side wall.

12. The wax mold of claim 1, wherein a depth of each of the plurality of sockets is about one half a thickness of the pattern support at a location of the plurality of sockets.

13. The wax mold of claim 1, wherein the gate portion of each wax pattern has a perimeter corresponding in shape to an opening defined by each of the plurality of sockets.

14. The wax mold of claim 1, wherein each wax pattern includes a boss adjacent the gate portion, the boss configured to facilitate handling of the wax pattern by a machine.

15. The wax mold of claim 1, wherein each wax pattern is permanently retained in a respective socket by melted wax at an interface of the wax pattern and the socket.

16. A method of assembling a wax mold, the wax mold having at least one pattern support with a plurality of sockets formed therein, and a plurality of wax patterns, each wax pattern having a part portion conforming in shape to a part to be made by investment casting, and an integrally-formed gate portion, the method comprising:

positioning the gate portion of each of the wax patterns into a corresponding one of the plurality of sockets such that the wax patterns are supported within the sockets; and after the wax patterns are supported within the sockets, heating an interface between each socket and wax pattern to weld the wax patterns into the respective sockets.

17. The method of claim 16, wherein the positioning and heating steps are performed by a human operator.

18. The method of claim 16, wherein the positioning and heating steps are performed by a machine.

19. The method of claim 16, wherein the wax mold includes first and second pattern supports and a post, and wherein the method further comprises:

securing the first pattern support to the post at a location of the post having a first dimension; and securing the second pattern support to the post at a location of the post having a second dimension smaller than the first dimension.

20. The method of claim 16, wherein heating the interface includes applying heat from only a single end of the interface.

21. The method of claim 16, wherein heating the interface includes rotating the wax mold relative to a heat source to move the heat source around an outer perimeter of the at least one pattern support.

* * * * *